US005135440A

United States Patent [19]

Smollar et al.

[11] Patent Number: 5,135,440

[45] Date of Patent: Aug. 4, 1992

[54] SYSTEM OF WATER TOYS WHICH MAY BE ASSEMBLED IN PLAY GROUPINGS

[75] Inventors: Marvin Smollar, Northbrook; Richard Mazursky, Glenview; Bette Kaelin, Des Plaines; David Waskin, Skokie, all of Ill.

[73] Assignee: Marchon, Inc., Vernon Hills, Ill.

[21] Appl. No.: 440,896

[22] Filed: Nov. 22, 1989

[51] Int. Cl.[5] ..... D63G 31/00

[52] U.S. Cl. ..... 472/128; 472/129; 472/134

[58] Field of Search ..... 272/1 B, 565 R; 472/128, 129, 134

[56] References Cited

U.S. PATENT DOCUMENTS

| | | |
|---|---|---|
| D. 196,558 | 10/1963 | Choy . |
| D. 198,092 | 4/1964 | Gourbore . |
| D. 227,583 | 7/1973 | Bowkley . |
| D. 259,356 | 5/1981 | Feretti . |
| 2,443,440 | 6/1948 | Alvarez . |
| 2,483,789 | 11/1946 | Smith . |
| 2,529,872 | 11/1950 | Hasselquist . |
| 2,551,673 | 5/1951 | Hasselquist . |
| 2,616,096 | 11/1952 | Hasselquist . |
| 2,714,726 | 8/1955 | Hasselquist . |
| 2,718,014 | 9/1955 | Mizrach et al. . |
| 2,719,982 | 10/1955 | Hasselquist . |
| 2,724,123 | 11/1955 | Kesler . |
| 2,886,828 | 5/1959 | Lattuca . |
| 2,990,837 | 3/1959 | Cushman . |
| 3,001,207 | 9/1961 | Nail . |
| 3,363,268 | 6/1965 | Friedlander . |
| 3,373,450 | 3/1968 | Brooks . |
| 3,497,877 | 4/1969 | Diemond . |
| 3,665,523 | 5/1972 | Chase . |
| 3,668,715 | 6/1972 | Chase . |
| 3,708,807 | 1/1973 | Chase . |
| 3,793,653 | 2/1974 | Brooks . |
| 3,908,205 | 9/1975 | Chase . |
| 3,962,734 | 6/1976 | Chase . |
| 4,642,822 | 2/1987 | Tvengsberg . |
| 4,750,733 | 6/1988 | Foth ..... 272/56.5 R |

OTHER PUBLICATIONS

Bilnor Corp Product Brochure © 1951.

*Primary Examiner*—Richard E. Chilcot, Jr.
*Attorney, Agent, or Firm*—Laff Whitesel Conte & Saret

[57] ABSTRACT

A child's water toy comprises a pool which has inflatable (with either air or water) sides with a floor extending between them. One or a number of applique accessories may be heat sealed to the bottom or the sides of the pool. Exemplary of these applique accessories are slides, floating animal figurines, and the like. Bobbing accessories are counter balanced accessories which may either float upright to be a playmate for the child or bob over to become a float on which the child may ride. The bobbing toy may have articulated joints which make it appear to change its shape depending upon whether it is standing upright or lying down. Still other accessories are scenery in the nature of trees, islands, vines, or the like, which may shower or drip water. These accessories may be assembled in different ways to provide play groupings.

11 Claims, 5 Drawing Sheets

SYSTEM OF WATER TOYS WHICH MAY BE ASSEMBLED IN PLAY GROUPINGS

This invention relates to a system of water toys and more particularly to yard toys for relatively small children where a selection among a plurality of accessories may be assembled into a play grouping.

Many water toys are available for relatively small children to play with, especially in their backyard. Among the more popular of these water toys are such things as pools, slides, sprinklers, and the like. A characteristic of these toys is that the child can only do one thing and does not have a challenge for fantasy or imaginative play. For example, in a pool, there is not much to do except to splash or to play with floating toys.

Some of the recent innovations have added a few features which have enabled the child to broaden the scope of his play. For example, showers have been combined with figurines, such as animal heads, to make it appear that an animal is associated with the game. Some slides have had curtains displaying images which the child may slide through in order to integrate his actions with his fantasies. However, heretofore, there has been no systemic approach to water toys wherein a plurality of different principles may be selected and combined in order to provide features which stimulate fantasy and imaginative play.

Accordingly, an object of this invention is to provide a system of water toy devices and accessories which may be combined in different ways to provide a plurality of different play groupings for backyard games.

Another object of this invention is to provide a fantasy stage setting which may enable a child to act out a story of his own imagination. Here an object is to provide a plurality of accessories which may be selected for a play grouping, and then further accessories may be added to renew interest.

Still another object of the invention is to provide toys which may also be used separately, and apart from any collection, play grouping or stage setting. In this connection, an object is to provide accessories which may be carried off to a beach or pool, for example, as separate toys to be used alone.

In keeping with an aspect of the invention, these and other objects are accomplished by providing a pool which has inflatable (with either air or water) sides, with a floor or lower surface below them. A number of applique accessories may be heat sealed to either the bottom or the sides of the pool. Exemplary of these applique accessories are slides, animal figurines, floats, and the like. Other bobbing accessories are counter balanced either to float upright in order to be a playmate for the child or to bob over and become a float which the child may ride. The bobbing toys may have articulated joints which make them appear to change shape or posture depending upon whether they are standing upright or lying down and floating on the surface of the water. Still other accessories are scenery, in the nature of trees, islands, vines, or the like, which may shower or drip water. These accessories may be assembled in different ways to provide different play groupings. The manufacturer may either select the accessories and sell them as a kit or sell the accessories separately, allowing the purchaser to make the selection.

Preferred embodiments are shown in the attached drawings wherein.

Figure 8A:
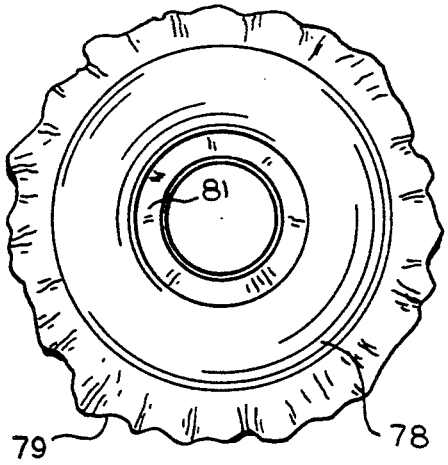
FIG. 8A is a plan view of an "island" which may be used separately or on the palm tree.
Figure 8:
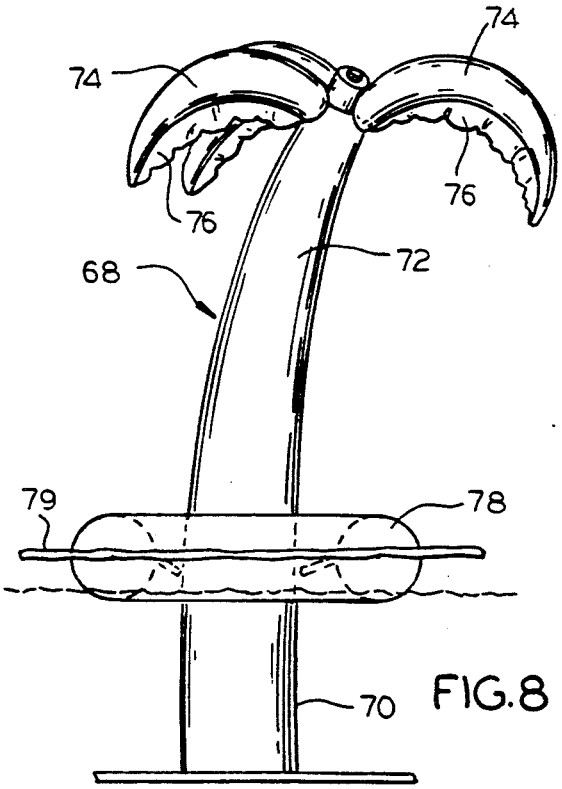
FIG. 8 is a side elevation of a showering palm tree scenery accessory.
Figure 9:
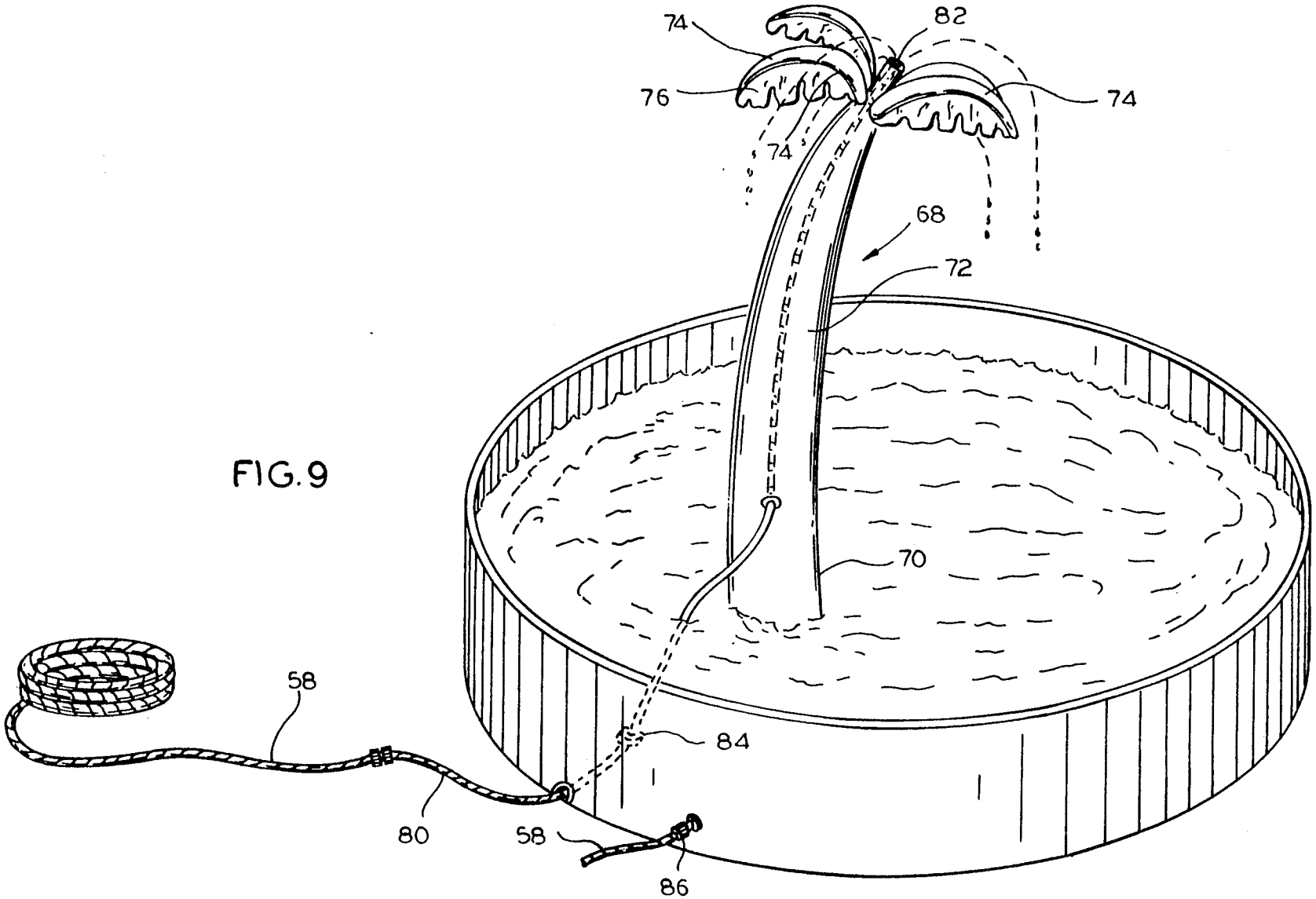
Figure 10:
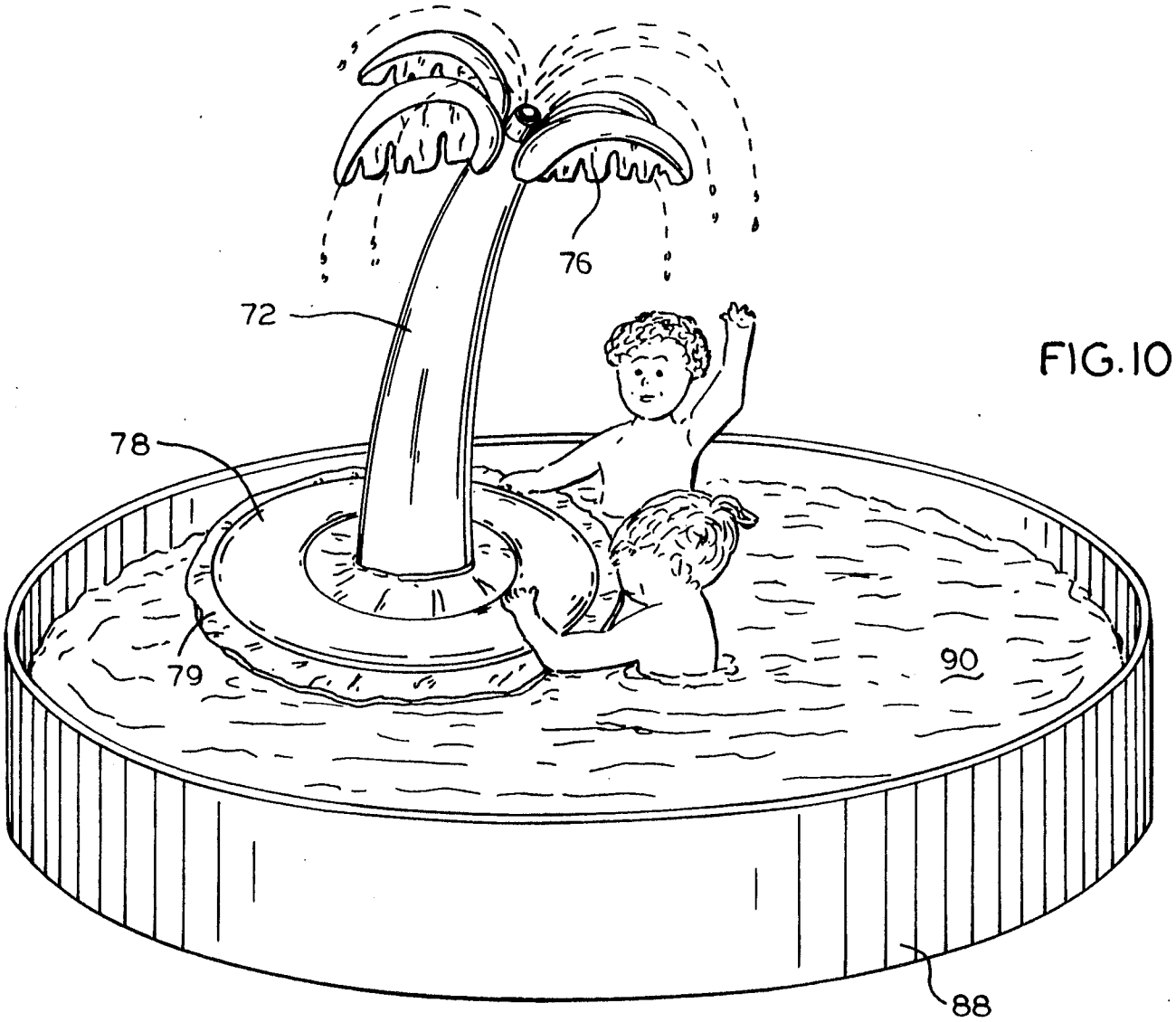
Figure 11:
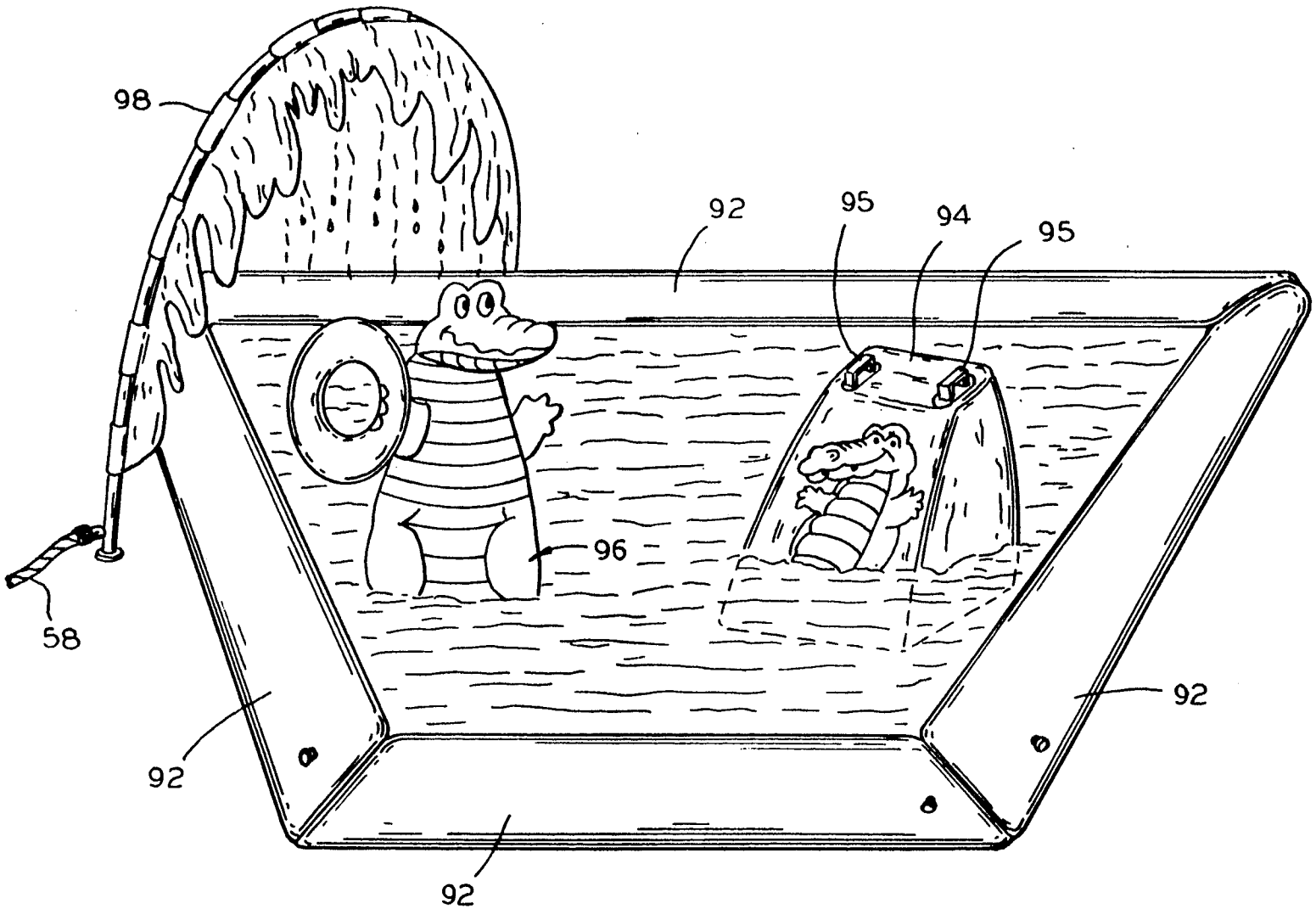

FIG. 9 schematically shows the internal construction and operation of the showering palm tree scenery accessory of FIG. 8;

FIG. 10 is a first example showing a selection of accessories forming a first play grouping in a pool; and FIG. 11 is a second example showing another selection of accessories forming another play grouping in a pool.

Preferably, substantially all of the parts and accessories described herein are made of sheet vinyl, or a similar suitable material, which is die cut and heat sealed; however, any suitable material may be used to make these items. Also, sometimes the sheet vinyl may be imprinted with a line and the purchaser may be instructed to cut along the line. The accessories are inflated with air when floating is important and with water when an anchoring weight is important.

One of the problems which has been encountered with floating water toys is that they are generally unstable. For example, a floating horse might have a generally barrel shaped body with a head rising from one end. If the child tries to sit on the barrel shaped body, the child's weight is out of the water, the horse rolls over, and throws its rider. This is especially disturbing to younger children. Thus, as a practical matter most inflated toys are little more than simple floats or push toys.

Figure 1:
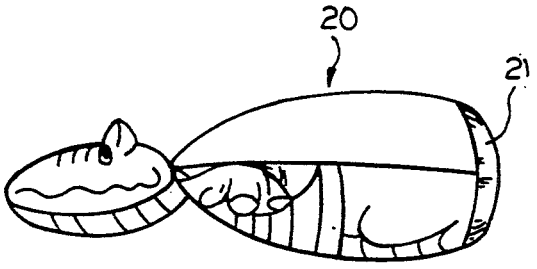
FIG. 1 is a side elevation of a first accessory in the form of a separate toy.

The toy 20 (FIG. 1) is in a shape suggestive of an animal, here a crocodile 22. Of course, it may also have any other suitable form and appearance. The child may also straddle the float 20 or use it in almost any other manner. This particular toy may have sand in a rounded bottom 21 in order to make it stand upright when in a pool of water or to allow it to roll over when a child sits on it.

Figure 2:
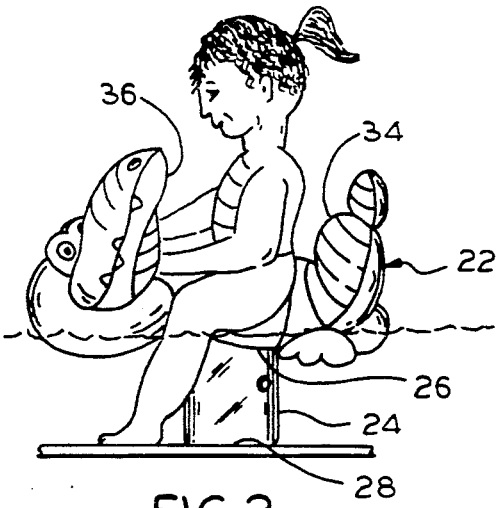
FIG. 2 is a side elevation of an applique accessory in the form of a chair-like floating toy secured to the bottom of a pool.

FIG. 2 illustrates one of the inventive floating toys in the form of an applique accessory which is attached to the bottom or side of the pool and which floats on the top of the water in the pool.

The entire figure may be a single compartment, somewhat similar to a large balloon; or, the various parts (head, stomach, body, etc.) may be separate air tight compartments. Usually, a single compartment is easier to inflate. However, some of the separate compartments would continue to float if other compartments should spring a leak. The choice between one or many compartments is made by a manufacturer or distributor based on what he wants to offer and whether the safety of multi-compartments is important, as it might be at a beach or deeper pool.

Attached to and dependent from the back or underside of the floating toy 22 (FIG. 2) is a separate air tight, stabilizing, support compartment 24. Compartment 24 is attached on one side 26 to the bottom of floating toy 22 and on an opposite side 28 to the top side of the pool bottom 30. The user has his option of whether or how much to inflate the floating toy compartment 22. If stabilizing compartment 24 is not inflated, it is a stabilizing tie that anchors and orientates the floating toy. The float may move some distance back and forth; however, the uninflated sheet vinyl 24 still restrains and stabilizes the float 22 in an upright position to prevent it from rolling over. If stabilizing compartment 24 is inflated, the position of float 22 is stabilized, becoming more stable as the inflation level of compartment 24 is increased. Thus, for a very small child, the compartment 24 may be inflated as much as possible so that the float becomes practically immovable. For an older child, the compartment 24 is not inflated at all so that the float is a little—but not too much—more difficult to ride. For other children, the degree or amount of inflation may be any selected amount.

The floating toy animal 22 (FIG. 2) is designed in a preferential mode, to be similar to a chair with a back support 34 and a front support 36 for the child to cling to. Thus, a child who sits on the floating toy 32 may clutch the front support 36 and lean back on support 34, feeling secure because the toy is like a chair. Again, the stability of the float toy 32 may be adjusted over a range extending from lower stability (no air in compartment 24) to very stable (compartment 24 at maximum inflation).

The relative length of the tether formed by part 24 in the floating toys 20, and the weight of the child have an effect upon how high the child floats or how low the child settles into the water. FIG. 2 has been drawn to show a very young child who feels more secure if she sits deeper in the water rather than above it.

Figure 5:
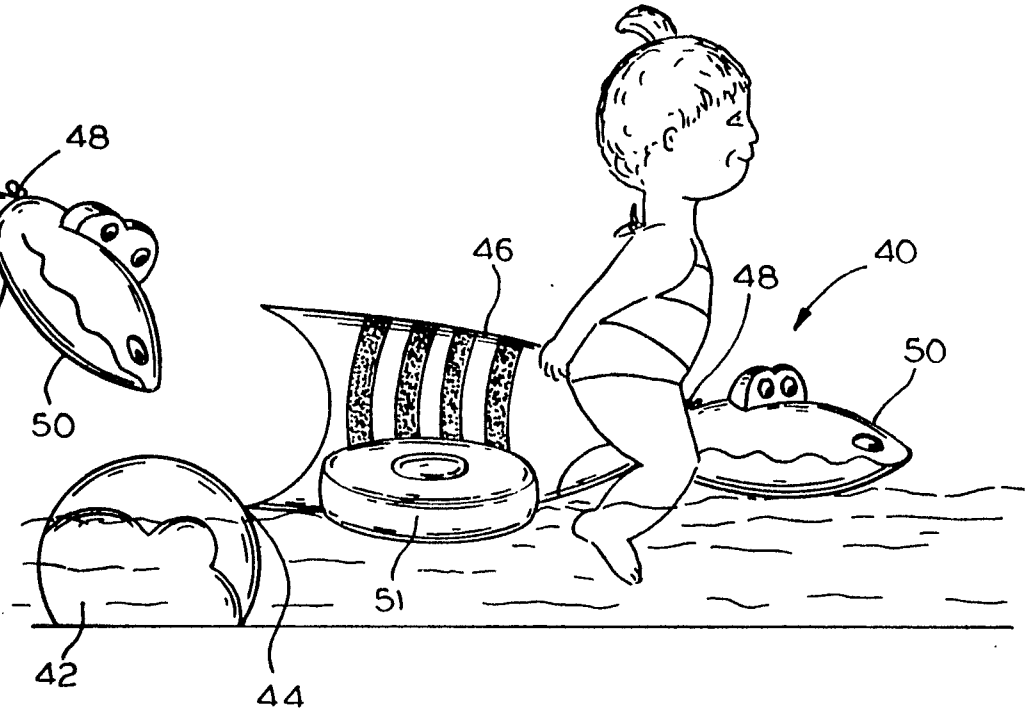
FIGS. 3–5 are side elevations of a bobbing toy, in three positions.
Figure 4:
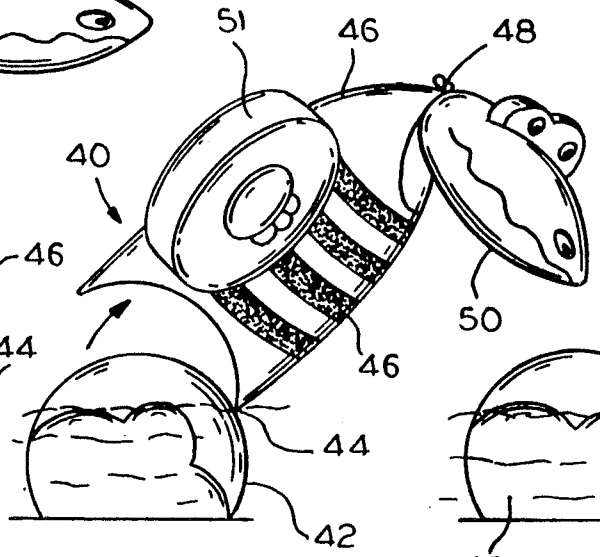
Figure 3:
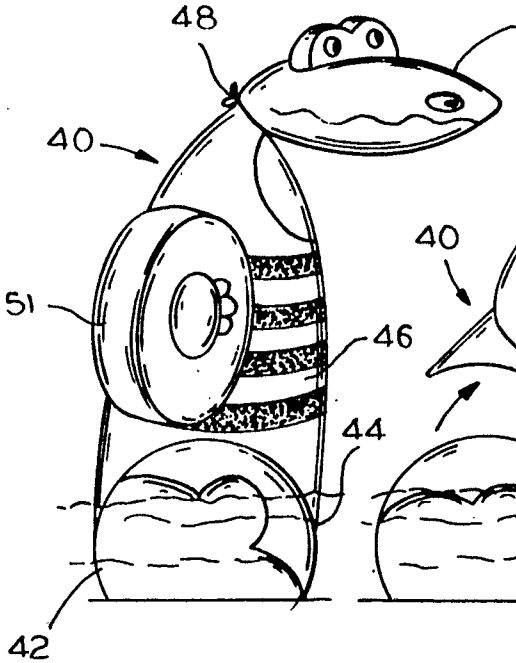

FIGS. 3-5 show a bobbing toy 40 which is movable between several positions. It may be desirable to move this kind of toy from place to place in the pool. For example, a child might want to mount his horse on one side of the pool and then drag it to the other side, pretending that he has traveled over that distance on horseback. Perhaps a mother might want to place the toy where she can see it and the child playing with it while she is reading, for example.

Coupled at 44 to the water bag 42 is another compartment forming a body 46 which is inflated with air. Normally, the body 46 stands upright and in a vertical position, as shown in FIG. 3. Coupled at 48 to the upper end of the body 46 is a third compartment or head section 50, which in this example simulates a head of a crocodile. Thus, when in the position of FIG. 3, bobbing toy 40 might suggest a standing crocodile. As here shown, the toy has a suitable device 51 which is a hand hold to which a child may cling when the toy is floating. In this particular case, the hand hold 51 is a floating ring or life saver.

If a child pulls on the inflated body 46, it begins to fall forward as it swings on connection 44, as shown in FIG. 4. As the upper end of the body 46 swings outwardly, gravity causes the head 50 to also swing forward pivoting on connection 48. Since the head 50 is inflated, both it and the body float on the surface of the water in proper alignment. As a result of connection 48, the head is permitted to take a position that creates the proper simulation of the animal supporting the child. (FIG. 5). The animal now forms a floating toy on which a child can sit. The life saver or hand hold device 51 floats in a position where the child may hold it and support himself while he is in the water.

The weight of the water bag 42 anchors and stabilizes the floating toy so that it will not roll over in response to the weight of the child. Still the floating toy bobs up and down with the motion of the water. The experiences enjoyed by the child with such a bobbing toy are different from the experiences enjoyed on the floating toy of FIGS. 1 and 2.

Figure 6:
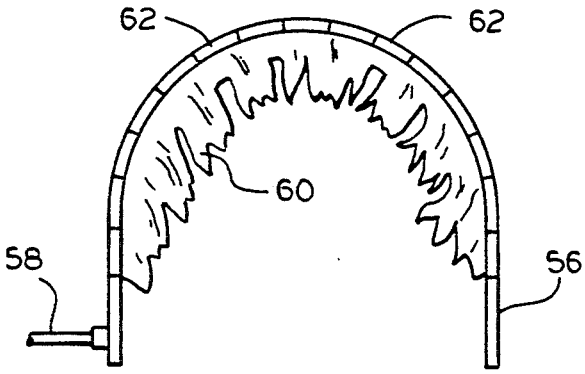
FIGS. 6, 7 are a side elevation and a fragment of a dripping scenery accessory.
Figure 7:
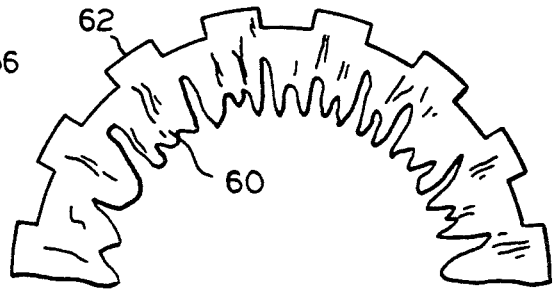

FIGS. 6 and 7 provide a first example of a scenic accessory which may form a back drop for a play grouping of water toys. A plastic pipe or an inflated arch 56 is formed into an inverted U-shape with a plurality of holes formed on the inside arc of the bight of the "U". The ends of the plastic pipe or inflated arch 56 may be pressed into or rested upon the earth so that the arch stands upright. One end of the pipe 56 is plugged and, the other end is connected to a garden hose 58. Therefore, when the water is turned on, it flows through the garden hose 58, fills the pipe 56 and either drips or sprays out the holes, depending on how far the faucet is opened.

Along one edge, a sheet of vinyl 62 is die cut to give an appearance of hanging leaves, for example. The opposite edge of the vinyl sheet 60 is formed into tabs 62 which are folded over and heat sealed to the vinyl 60, thereby forming a plurality of loops. The pipe 56 is threaded through the loops to hang from the top of the arch formed by pipe 56. Or, if the arch 13 is an inflated member the leaves are either die-cut from or heat sealed to the material forming the arch. The water is preferably applied through the garden hose 58 at a very low pressure so that water merely drips off the leaves to simulate a jungle habitat. Of course, the child may also turn up the water pressure to simulate a tropical downpour, water fall, or anything else which his fantasy may dictate.

Another scenic accessory is a palm tree seen in FIGS. 8, 9. The palm tree 68 may have a water filled bag 70 as a weighted base that is heavy enough to anchor and hold the tree in an upright position. Or the base of the tree may be heat sealed to the bottom of the pool. The rest of the tree is an air inflated trunk 72 and limbs 74. Hanging from the inflated limbs 74 are die cut vinyl leaves 76.

An optional scenic accessory is an inflated ring or "island" 78 (FIGS. 8, 8A, 10) which is here shown as being friction fit around the trunk of the tree. This island may be shaped somewhat like a doughnut and may have an oddly shaped perimeter 79 to provide an irregular "coast line" with sand, shells and the like printed on the top and water printed on the bottom. Actually, the island may be two sheets of vinyl which are heat sealed to each other in two spaced concentric rings, to form between them an inflatable ring. Shore line 79 may be fringe which is die cut from the two vinyl sheets, out side the outer most of the heat sealed rings. A similar fringe 81 in the center of the ring may be imprinted to be the "land" portion of the island between the inflated ring and a tree trunk. The island 78 is air inflated to float on the surface of the water. The size and buoyancy of the island, and its friction fit around the trunk, help stabilize the tree trunk in its upright position. It also provides a place for children to hold and rest their toys or play things. It also provides a place for children to rest against while playing in the pool. Of course, the island can also be used by itself as a completely separate and freely floating ring.

The preferred construction of the tree is seen in FIG. 9. A small and restricted diameter hose 80 extends from a garden hose 58 at a point outside the pool and up the inside of the trunk to a shower head 82 at the top of the trunk. In one form, hose 80 fits under the floor or bottom of the pool, entering the pool at 84 via a fitting which is heat sealed to the floor of the pool. This embodiment greatly reduces the length or eliminates a hose inside the pool for a child to trip over. In another embodiment, the garden hose 58 might connect to a restricted hose and enter via a fitting 86 at the side of the pool. A side entry at 86 causes the hose to run through the pool and not under the pool. This embodiment provides a greater flexibility in setting the tree at a desired location.

The water pressure is preferably adjusted so that water merely drips off the leaves 76 of the palm tree, although the water pressure may be increased to provide a tropical downpour.

FIG. 10 illustrates one example of how a selection of the various accessories might be assembled into a first play grouping. Here, the pool 88 containing the water 90 is any suitable arrangement. For example, the side walls of pool 88 may be a stack of inflatable air or water filled tubes. In the pool, the scenic accessory tree 72 may be set at any convenient location and held in place by a water filled section or by heat sealing to the bottom of the pool. As here shown, the island 78 is in place around the tree. However, it may also be left off the tree and placed on the surface of the water to serve as a simple float. Also, as here shown, the tree is showering the children, but it could also be dripping or turned off.

Another example of a play grouping of selected accessories is seen in FIG. 11. The four wall 92 forming the sides of a truncated triangular or rectangular pool are sealed at the corners to form four separate units, each with its own inflation valve. Therefore, if one unit leaks, there is no effect in the other units. In this case, the pool 92 has an applique accessory, in the form of an inflatable waterside 94, which is heat sealed to the bottom of the pool. Two hand holds 95, 95 are formed on top of the slide to assist the user in mounting the slide. The base of the slide is wider than the top to provide stability and to compensate for compression responsive to water pressure. The back of the slide is vertical to prevent the child from accidentally sliding down or having to climb up a steep slope. A bobbing toy 96, constructed as shown in either FIG. 1 or FIGS. 3–5, is located at any convenient position within the pool. Across a corner of the pool is a scenic accessory 98 in the form of a dripping palm tree or vine, as described in FIGS. 6, 7.

It should be understood that the accessories and play groupings described herein are given by way of example, only. Other items may be designed, using the same principles. Therefore, the appended claims are to be construed broadly enough to cover all equivalent structures.

The claimed invention is:

1. A water toy comprising a pool having sides and a floor, at least the floor being made of a material which is heat weldable, a selection of accessories forming a play grouping within said pool, said accessories comprising at least two different inflatable figurines also made of a material which is heat weldable, at least one of said figurines being an applique accessory heat welded to a floor of said pool, and means comprising at least one of said accessories for showering at least a portion of said pool with water to simulate a rain or a dripping condition following a rain.

2. The toy of claim 1 wherein said accessory includes at least one item taken from a group including applique, bobbing, and scenic accessories.

3. The toy of claim 1 wherein said accessory includes an inflatable floating toy having dependent therefrom an inflatable compartment that is secured to a bottom of said pool, said compartment being inflatable separately from said toy, whereby said compartment may or may not be inflated to substantially any level independently from any inflation of said floating toy.

4. The toy of claim 3 wherein said floating toy is an air mattress in the form of a figurine which is of interest to a child.

5. The toy of claim 3 wherein said floating toy is an inflatable ride-on in the form of a figurine which is of interest to a child.

6. The toy of claim 1 wherein one of said selected accessories is a bobbing toy comprising a weighted bottom section, an inflated middle section, and an inflated end section, said bottom section, middle section, and end section being connected to each other to form articulated sections for enabling said toy to stand-upright on said weighted bottom or to fold over with at least one of said middle and end sections floating on a surface of water in a pool of water.

7. The toy of claim 5 and at least one applique accessory bonded to a floor of said pool, said applique accessory comprising a floating toy with an inflatable compartment dependent therefrom, one side of said inflatable compartment opposite said floating toy being a part of said applique accessory that is bonded to said floor of said pool.

8. The toy of claim 1 wherein said applique accessory comprises an inflatable slide which has a bottom side which is wider than its top side and which has two hand holds located on said top side of said inflatable slide.

9. The toy of one of the claims 7 or 8 wherein said at least one of said accessories is a simulated tree or vine comprising an inverted U-shaped pipe member with a sheet fitted over and supported by the pipe to provide simulated leaves extending over a top of said U-shape, and a plurality of holes in said pipe member for dripping water onto said sheet with said simulated leaves.

10. The toy of one of the claims 7 or 8 wherein said at least one of said accessories is a simulated palm tree comprising at least an inflated trunk and simulated hanging leaves near the top of said trunk, and means extending through at least part of said trunk for dripping water on said leaves, and an inflated accessory which has dimensions that may be friction fit onto the trunk of said tree for providing buoyancy to said tree.

11. The toy of claim 1 wherein said one of said accessories is a simulated palm tree comprising an inflated trunk and limbs, simulated leaves hanging from said limbs, and means comprising a hose extending through at least said trunk to shower head means for dripping water on said leaves.

* * * * *